US008074991B2

(12) United States Patent
Chen et al.

(10) Patent No.: US 8,074,991 B2
(45) Date of Patent: Dec. 13, 2011

(54) LET ME ROLL SIC BO

(76) Inventors: Hui Chuan Chen, Quincy, MA (US); Gen Kang Chen, Quincy, MA (US)

( * ) Notice: Subject to any disclaimer, the term of this patent is extended or adjusted under 35 U.S.C. 154(b) by 118 days.

(21) Appl. No.: 10/935,020

(22) Filed: Sep. 7, 2004

(65) Prior Publication Data

US 2006/0049578 A1 Mar. 9, 2006

(51) Int. Cl.
*A63F 9/04* (2006.01)

(52) U.S. Cl. ..... 273/274; 273/138.1; 273/138.2; 463/16

(58) Field of Classification Search ..... 273/274, 273/138.1, 138.2, 146; 463/16, 22
See application file for complete search history.

(56) References Cited

U.S. PATENT DOCUMENTS 5,791,651 A * 8/1998 Bryant ..... 273/274
6,234,482 B1 * 5/2001 Henderson ..... 273/274
6,336,633 B1 * 1/2002 Webb ..... 273/274
6,378,869 B1 * 4/2002 Hedge et al. ..... 273/274
6,508,469 B2 * 1/2003 Promutico ..... 273/274
6,601,848 B1 * 8/2003 Timmons, Sr. ..... 273/146
7,413,193 B2 * 8/2008 Cacas ..... 273/274
2003/0075864 A1 * 4/2003 Swavy et al. ..... 273/146

OTHER PUBLICATIONS

"Sic-Bo", European and Asian Games, Syd Helprin, Gambling Times Incorporated, 1986, pp. 194-199.*

"Sic-Bo", Tripp Plastics, A Division of Tripp Enterprises, in the USPTO Oct. 1994.*

* cited by examiner

*Primary Examiner* — Benjamin Layno

(57) ABSTRACT

Let Me Roll Sic Bo is a dice game blended Sic Bo with traditional craps game. It is using three regular dice (cubes). Each die has six sides and different number of spots on it (from one to six). Each player will take a turn to shoot the dice follow the clockwise. Players can wager on nine main designed betting areas to win different odds.

7 Claims, 2 Drawing Sheets

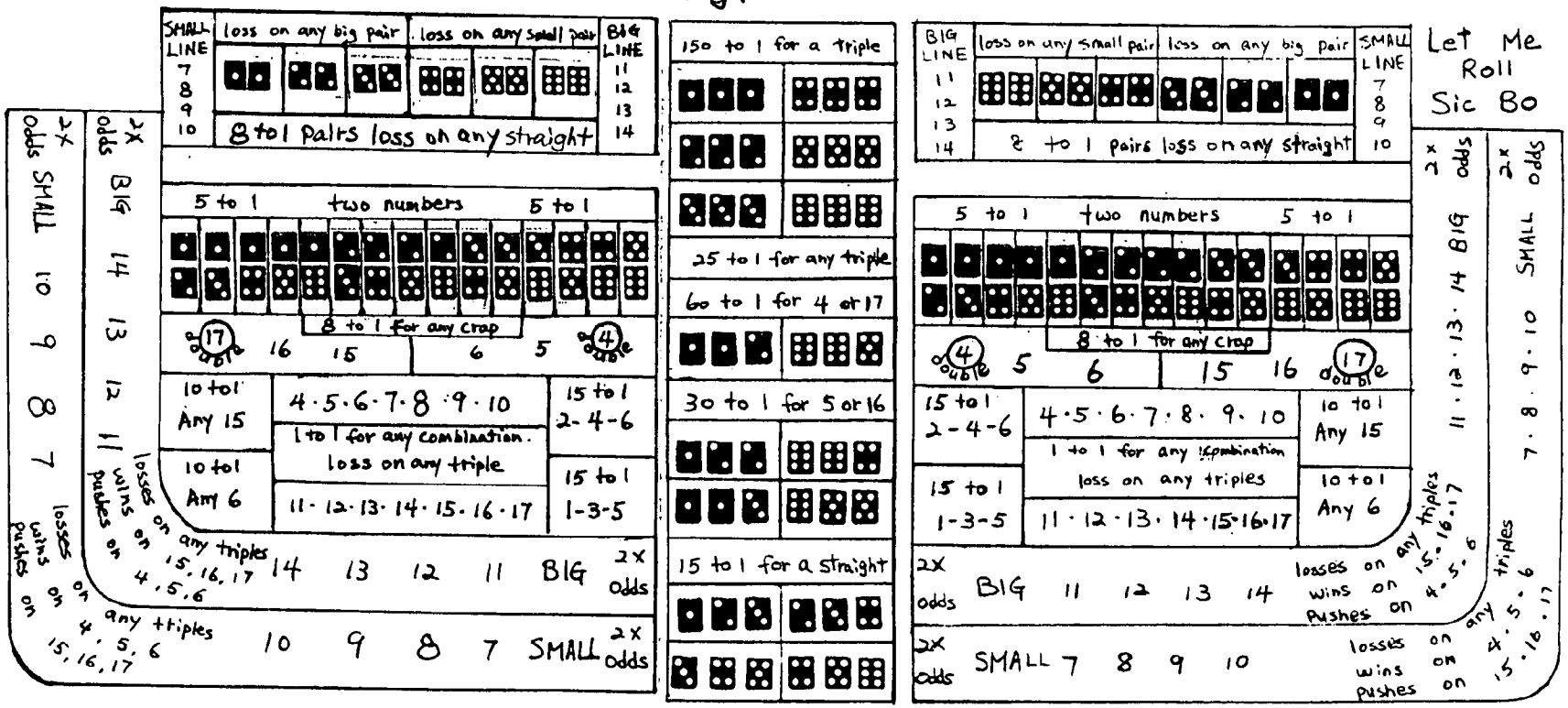
Fig 1
Let Me Roll Sic Bo
SMALL LINE
BIG LINE
loss on any small pair
loss on any big pair
8 to 1 pairs loss on any straight
5 to 1
two numbers
8 to 1 for any crap
4 double
17 double
15 to 1 2-4-6
15 to 1 1-3-5
10 to 1 Any 15
10 to 1 Any 6
4·5·6·7·8·9·10
1 to 1 for any combination loss on any triple
11·12·13·14·15·16·17
2X odds BIG 14 13 12 11
2X odds SMALL 10 9 8 7
losses on any triples
wins on 15, 16, 17
pushes on 4, 5, 6
15 to 1 for a triple
25 to 1 for any triple
60 to 1 for 4 or 17
30 to 1 for 5 or 16
15 to 1 for a straight
loss on any small pair
loss on any big pair
2 to 1 pairs loss on any straight
11 · 12 · 13 · 14 BIG
7 · 8 · 9 · 10 SMALL
2x odds
any triples
losses on
wins on
pushes on Fig 2
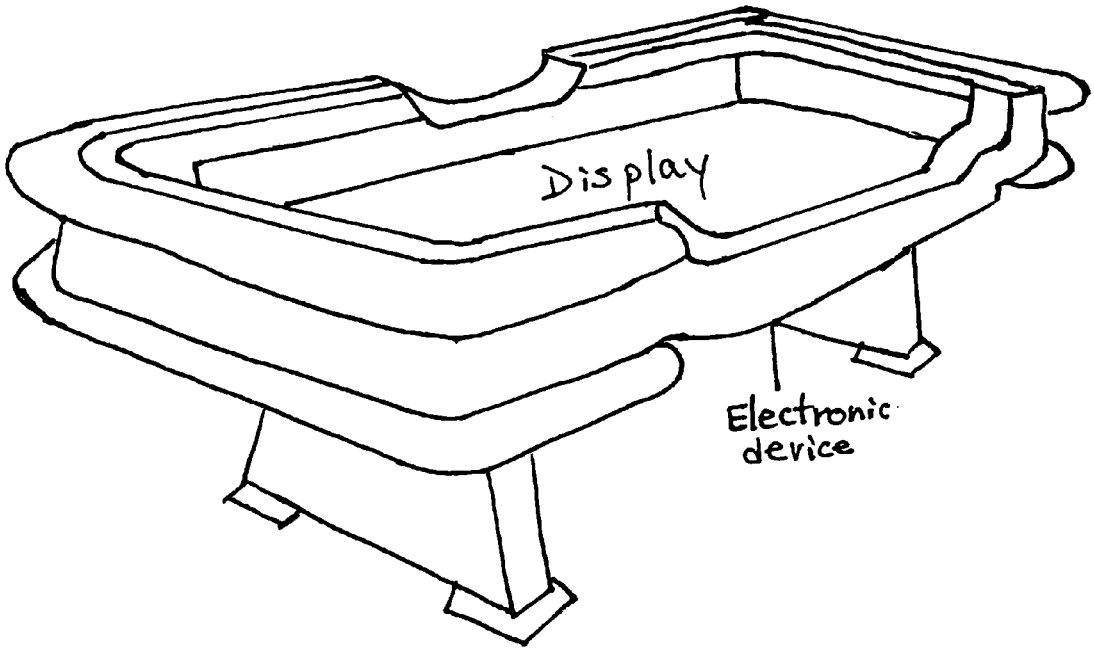
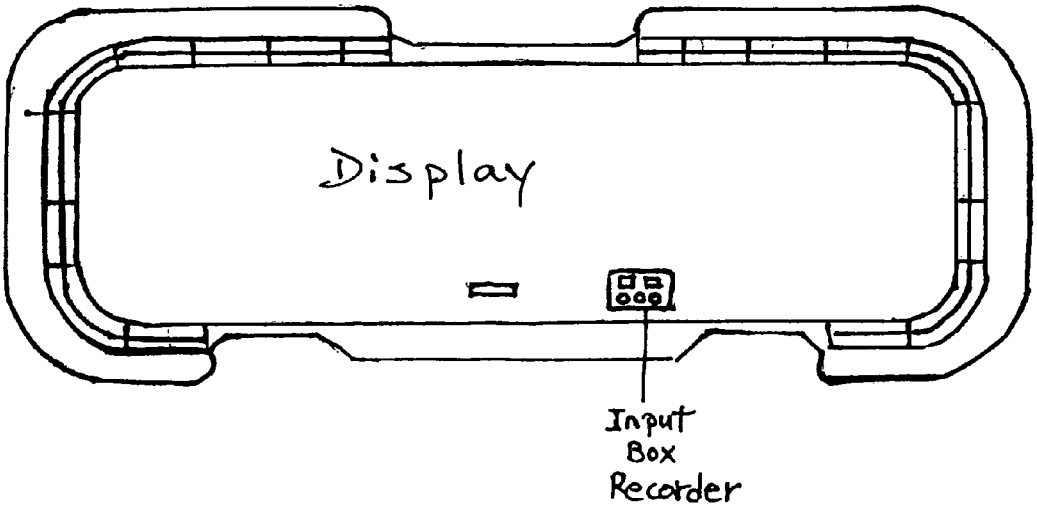

LET ME ROLL SIC BO

FIELD OF THE INVENTION

The present invention, Let Me Roll Sic Bo, relates to Sic Bo and Craps dice game. Player rolls three dice to establish the point. Player has to roll the point again to win the game.

PRIOR ART

Craps is a casino game played by rolling a pair of dice repeatedly. It has the pass line bet and don't line as the main wager spots in order for patrons to shoot the dice.

On the first roll, called the "come-out" roll, players who place wagers on pass line will win when 7 or 11 is rolled (a "natural"). If 2, 3, or 12 is rolled (a "Craps number"), the pass line bet is lost. If any other number is rolled, namely 4, 5, 6, 8, 9, or 10, that number becomes the shooter's "point." If the point is repeated before 7 is rolled, the bet is won. If 7 is rolled before the point is repeated, the bet is lost. The pass line bet pays even money.

The pass line bet can be lost in either of two ways: Either the shooter rolls a craps number (2, 3, or 12) on the come-out roll, or he establishes a point and subsequently "sevens-out." In the former case, the same shooter continues to roll the dice. In the latter case, a new shooter takes control of the dice. Since most players at the craps table bet with the shooter, the shooter is motivated to win as many and lose as few pass line bets as possible before the inevitable seven-out. Rolling a crap number on a come-out roll is therefore something almost every shooter wants to avoid.

In standard craps, one can bet with the shooter or against him. To bet against the shooter, one makes a don't pass bet, which is the reverse of the pass line bet (i.e., the criteria for winning and losing are reversed, and the bet pays even money), with one exception: If 12 is rolled on the come-out roll, the don't pass bet is tied rather than won.

Sic-bo is an old and very popular Chinese dice game. House dealer shakes three dice in a bowl to result a combination number for player to bet on it. Players can bet on a wide variety of results with odds ranging from 190 to 1 to even. Three dice are rolled and covered then each player places a bet on a variety of things including: dice sum (3-18), a range of dice sums, a combination of two dice, a pair, a triple, a specific triple or whether the dice sum is big (11-17) or small (4-10). Once bets are placed, the dice are shown and a bank pays out. All the bets are one time betting, win or lose.

Sic bo table is an electronic table, "rectangular in shape with padded armrest upholstered in vinyl and with illuminated, computer driven display, trimmed with all wool gaming cloth on foam/nylon, underlay-customized logo available, safety glass-protective cover." produced by tripp Plastics company.

BACKGROUND OF THE INVENTION

According to Timmons, Sir. William P., U.S. Pat. No. 6,601,848, dice game is using electronic table. He claimed that "An electronic dice game comprising: an electronic device comprising one or more mechanical devices."

"The electronic dice game comprising a computer software program comprising code for playing the electronic device, said code being capable of (i) providing a display to a player, wherein at least a portion of the display comprises multiple bet placement locations;

(ii) enabling player interface with one or more of mechanical devices on the electronic device;

(iii) enabling a player to place a bet on one or more of the multiple bet placement locations shown on the display prior to a dice rolling step by selecting one or more of the multiple bet placement locations via one or more of the mechanical devices on the electronic device;

(iv) enabling a player to electronically roll dice;

(v) computing a payout for a winning roll; and (vi) providing winnings to a player for a winning roll."

"the electronic dice game comprises 3 electronically displayed dice and code that enables execution of special rules, wherein the special rules comprise: (1) If player A bets on a pair, no player bets on 3-of-a-kind, and 3-of-a-kind is rolled, player A wins the pair bet; and (2) If player A bets on a pair, and player B bets on 3-of-a-kind, and 3-of-a-kind is rolled, player B wins on the 3-of-a-kind bet, and player A wins the pair bet."

"so that a player can place multiple bets on multiple bet placement locations corresponding to multiple possible winning roll combinations shown on the game display prior to an electronic dice rolling step by selecting one or more of the multiple bet placement locations using the one or more mechanical devices on the electronic device; wherein the dice game has pay-out odds of up to "6000 to 1" or greater for a single roll of the dice, and wherein each roll of the dice has a potential winner; and wherein for the 3 dice game, the multiple bet placement locations comprise separate betting areas for (D individual numbers ranging from 4 to 17, (ii) any pair, (iii) any straight formed by the 3 dice (iv) any 3 of a kind, and (v) each specific 3 of a kind;"

One of the factors for determining the payout odds of a given roll is the probability of a given roll using a set number of dice, said three dice. The table below provides the probability of rolling a given number or combination of numbers using three dice.

Probability of given roll using three dice

| Number of Roll | 216 rolls | 65% Returns to player | 70% Returns to player | 85% Returns to player |
|---|---|---|---|---|
| 3 | 1/216 | 139.75 | 150.5 | 182.75 |
| 4 | 3/216 | 46.15 | 49.7 | 60.35 |
| 5 | 6/216 | 22.75 | 24.5 | 29.75 |
| 6 | 10/216 | 13.39 | 14.42 | 17.51 |
| 7 | 15/216 | 8.71 | 9.38 | 11.39 |
| 8 | 21/216 | 6.04 | 6.5 | 7.89 |
| 9 | 25/216 | 4.97 | 5.35 | 6.49 |
| 10 | 27/216 | 4.55 | 4.9 | 5.95 |
| 11 | 27/216 | 4.55 | 4.9 | 5.95 |
| 12 | 25/216 | 4.97 | 5.35 | 6.49 |
| 13 | 21/216 | 6.64 | 6.5 | 7.89 |
| 14 | 15/216 | 8.71 | 9.38 | 11.39 |
| 15 | 10/216 | 13.39 | 14.42 | 17.51 |
| 16 | 6/216 | 22.77 | 24.5 | 29.75 |
| 17 | 3/216 | 46.15 | 49.7 | 60.35 |
| 18 | 1/216 | 139.75 | 150.5 | 182.75 |
| Pair | 96/216 | 0.81 | 0.88 | 1.06 |
| Straight | 24/216 | 5.2 | 5.6 | 6.8 |
| 3 of a kind | 6/216 | 22.75 | 24.5 | 29.75 |
| Specific 3 of a kind | 1/216 | 139.75 | 150.5 | 182.75 |
| 7 to 10 | 88/216 | 0.95 | 1.02 | 1.24 |
| 11 to 14 | 88/216 | 0.95 | 1.02 | 1.24 |

The above probability of rolling a given number or combination of numbers using three dice is using on the Sic Bo dice game for a long period of time in the casino. However, players did not even get a chance to roll or shake the dice.

traditional Sic Bo dice game requires dealer to shake the dice in a bowl on a sic bo table that is wired with a computer to display the winning numbers and combinations and total number resulting from a roll of three dice. Players have no control on the outcome of win or lose.

Sic Bo dice game provides only one roll bets. Dealer shakes the three dice in a bowl, enter the pip number on the top of three dice into a computer device under the sic bo table, the winning numbers and combinations then light up, dealer collecting the losing wagers and paying the winning wager, the game is over. Players have no intention to stay a long time on the game.

The craps dice game used two standard dice. Each die has six faces with different dots from one to six. Player rolls the dice to establish the point and has to roll the same point to win the game. The varieties of betting areas provide more choice to the players for investing their wager.

The exciting part of craps game is to throw the dice. One of the players makes a monetary bet on either PASS line or DON'T PASS line or both to qualify shooting the dice. If shooter wagers on PASS line, he/she has to roll a total 7 or 11 to win the first throw, which is call "come out roll". If the shooter rolls a total 2, 3, or 12, he/she loses the wager on PASS line.

There are three phases, such as come out roll, intermediate roll, and decision roll in craps game. There are eight main betting areas, such as, pass and don't pass, field, place, hard ways, horn, any 7, any craps and 11 and come and don't come.

SUMMARY OF THE INVENTION

The present invention combines the two dice games to create a new dice game, Let Me Roll Sic Bo. It provides better odds and easy to play as Sic Bo and contains the exciting and fun part of Craps. Players are fully participating the game and feel having more control. All the payouts are printed on the layout. It reduces the confusion.

Casino provides five of dice having six faces numbered one to six for player to choose three out five. Player has to shoot the three dice simultaneously to the opposite of the table. The total numbers of dots on the up face of three dice, after they landed on the table, are used to determine the outcome of the winning or losing on betting.

Players can bet on two dice combination out of three dice combination and three dice combination.

Players have to wager on either BIG LINE or SMALL LINE in order to shot the dice. Player cannot wager on both big and small.

There are nine main betting areas, Line: BIG LINE (11, 12, 13, and 14) and SMALL LINE (7, 8, 9, and 10), Hard Ways (a pair), two numbers, any craps (4, 5, 6, 15, 16, and 17), Small Field, Big field, straight, and triples.

The rules of Let Me Roll Sic Bo are:

(a). The BIG and SMALL betting is a contract bet. They are the mandatory wagering for shooting the dice. Player cannot take it back (pick it up or lower the bet) in the process of rolling (before win or lose rolled).

(b). Shooter has to shot the numbers corresponding to the numbers on big line or small line to establish the point and shot it again to win the game.

(c). On the come roll, the wagers on both big Line and small Line will lose when any triples rolled. Big Line wins when 15, 16 or 17 rolled and pushes when 4, 5 or 6 rolled.

Small Line wins when 4, 5, or 6 rolled and pushes when 15, 16 or 17 rolled.

(d). The hard ways betting area of Let Me Roll Sic Bo is same as place bet area in the traditional craps game. These hard way bets are off on the come out roll.

After the point is established, the hard way bets will be working.

They will lose or no action until either Big Line (11, 12, 13, and 14) or Small line (7, 8, 9, and 10) is rolled. Big hard ways, hard 12, hard 10, and hard 8 will lose when Small Hard Ways hits. Small hard ways, hard 6, hard 4, and hard 2 will lose when Big Hard Ways hits. All the hard ways will lose when any straights rolled.

Players have the control on these bets. Player can have the hard way bets on and off anytime they want.

During the intermediate roll, all the hard ways will loss when any straight rolled.

(e). Two numbers, field (any combinations), straight, 5 & 16, 4 &17, any 6, any 15, even, odd and any craps are one roll bet. Players can place their bet any time they want. If the numbers did not roll, the bets lost. If the numbers rolled, players would get pay.

(f). The bets on triples are off on the come out roll. They are working after the point is established. Triples are one roll bet. It has to set up by dealer.

(g). Straight is one roll bet.

(h). On the decision roll, shooter who won will continue to shoot the dice. Shooter who lost will pass the dice to the new shooter.

(i). Shooter who established the opposite point that is against to where he is wagering on can switch the wager to the other side or pass the dice to a new shooter to finish the game.

The payouts: casinos have the options to choose the percentage they want to hold.

1. Hard Ways: any pair, two 6s, two 5s, two 4s, two 3s, two 2s, and two 1s, will be paid 8 to 1. The house holds about 33% advantage.
2. Any two numbers will be paid 5 to 1. The house advantage is about 16.7%.
3. The craps, 4 or 17, will be paid 60 to 1. The house advantage is about 15.28%.
4. The craps, 5 or 16, will be paid 30 to 1. The house advantage is about 13.89%.
5. The any combinations of 7, 8, 13, or 14 will be paid 2 to 1. The house advantage is about 12.50%.
6. The any combinations of 9, 10, 11, or 12 will be paid 1 to 1. The house advantage is about 12.50%.
7. The any triples will be paid 25 to 1. The house advantage is about 30%.
8. The triple will be paid 150 to 1. The house advantage is about 30%.
9. Both Big and Small will be paid 1 to 1. The house advantage is about 2.78%.
10. The straights will be paid 15 to 1. The house advantage is about 30%.

Equipments:

1. A crap table with Let Me Roll Sic Bo layout

A stick—to send and bring back the dice

A bowl—to hold the extra dice

A puck—mark the point

Five dice (each die has six sides and each side has white dot/dots from 1 through 6)—only three dice are use to roll.

A point recorder—optional: box man should press the three numbers to show the players what is rolled after the dice are rolled.

Crew: Four dealers (two base dealer, one stick dealer and one relief dealer) Two supervisors: one box person and one Floor person 2. A roulette table with Let Me Roll Sic Bo layout A dice shaker—clear plastic bowl with a lid, A puck—mark the point, Three dice

BRIEF DESCRIPTION OF THE DRAWINGS

Table layout of Let Me Roll Sic Bo

FIG. 1 table layout of Let Me Roll Sic Bo

Contains BIG Line and SMALL Line wagering areas.

Contains Small field, Big field and any craps, 4, 5, 16 and 17, wagering areas.

Contains two numbers wagering area.

Contains any 6 and any 15 wagering area.

Contains even, 2-4-6 and odd, 1-3-5 wagering area

Contains hard ways wagering area. It also called place bet wagering area.

Contains triples, any triples, and straight wagering areas.

FIG. 2 Let Me Roll Sic Bo table

A traditional craps table with an electronic device under the table is like traditional Sic Bo table.

A point recorder is on the top of the table for input the result of rolling three dice.

OTHER DESCRIPTION OF THE INVENTION

The present invention, Let Me Roll Sic Bo, can be played in the casino as a variation of dice game and at home in the form of a board game. The setting for a family board game is including:

(a). A pot of gold—contains different size of fake nuggets from gram to kilogram.

One one-kilogram nugget

Ten one-hectogram nuggets

Twenty fifty-decagram nuggets

Forty twenty-five-decagram nuggets

One hundred one-decagram nuggets

Twenty fifty-gram nuggets

Forty twenty-five-gram nuggets

Two hundred one-gram nuggets (b). Three dice are having six faces numbered one to six.

(c). A board is printed the layout with the wagering areas, Triples, any triples, straight, hard ways, two numbers, any 6, any 7, 2-4-6, 1-3-5, 4 & 17, 5&16, Small field, Big Field, BIG LINE, and SMALL LINE and payouts.

The final goal of Let Me Roll Sic Bo board game is to obtain the Pot of Gold.

(a). One of the players should be the bank, holding the pot of gold. Other players take a turn to roll the dice and betting on the numbers.

(b). The dice should be rolled in the pot as the game is in process.

(c). The game is over when the bank is bankrupted.

The present invention, Let Me Roll Sic Bo, played in the casino, wherein the casino will be the bank. It needs four dealers (two base dealers, one stick dealer and one relief dealer) and two supervisors: one box person and one floor person to watch the game.

1. The two base dealers are responsible for all the bets on his/her side, half of the table. It includes booking the bets, making changes, place the hard ways and two numbers, take or pay the bets, marking and removing the pucks from numbers called as the points of the game, and watches the dice when they land on his/her side.
2. The stick dealer is responsible for booking and placing all the one-roll bets between Box man and stick dealer, sending the dice, calling the total of the dice after they stopped, and watching the base dealer on the dice landed for every roll.
3. Players are taking turns (clockwise) to roll the dices from where he/she stands to the opposite side of the table. Thus, stick dealer has to send five dices to the player on the come out roll and make sure shooter can only pick three dices out of five. The shooter has to roll three dices at the same time. The stick dealer has to watch the dices and make sure three dice are shooting to the other side of the table simultaneously.
4. Stick dealer has to call the point, for instance, 4, 4, 6, the point is 14, Big, Mark the Big, 2 to 1 for 14, 5 to 1 for four-six. Then, stick dealer has to bring the three dices back to the center of the table, place them right in front of the box man.
5. The two base dealers have to mark the point, and pay the field if there is a bet and working bets.
6. The field bets, any craps and any combinations bets are self-service betting areas. Base dealers have to pay or take the wagers according to the point that is roll.
7. Stick dealer has to book all the one roll bets in the center of the table and place them on the right spots. When one roll bet hits, sticker dealer has to direct base dealers to pay the patrons who won from base to stick.
8. When there is a winner, base dealer has to take the losing bets first, and then pay the winner bets from base to stick.
9. After the point is established, both wagers on small and big will not lose when triples and any craps rolled.
10. Hard way bets (place bets) could lose any time during the intermediate roll and decision roll when either big or small rolled. Dealer has to pay the place bet from stick to base.
11. The bets on triples and any triples are off on the come out roll. If player wants them working on the come out roll, it will work as place bet. Big triples, (4, 5, and 6) will lose when small (7, 8, 9, and 10) is rolled. Small triples (1, 2, and 3) will lose when there big (11, 12, 13, and 14) is rolled.
12. Triples and any triples will work as place bet after the point established. They will lose when the shooter wins or lose. Triples 4, 5, and 6 will lose only when Small, 7, 8, 9, and 10 rolled. Triples, 1, 2, and 3, will lose only when Big, 11, 12, 13, and 14 rolled.
13. Stick calls Dealer has to verify which side the shooter is wagering on. For example, shooter is wagered on Big.

Dealer has to announce that shooter is shooting from Big.

a. Come Out Roll—When there is no point, Big or Small.

1. Triple six, all bets in.

Two, three, five, total is 10, marks the small (if shooter is wagering on small). Single the field. 5 to 1 for two-three, two-five, and three-five. Working bets have action. (The hard 8, hard 10, and hard 12 will lose.)
2. Three, five, six, total is 14, marks the big (if shooter is wagering on big). Double the field. 5 to 1 for three-five, five-six, and three-six. Working bets have action. (The hard 2, hard 4, and hard 6 will lose.)
3. One, two, two, total is five. Five is crap, both lines (big and small) in. Triple the any craps. 5 to 1 for one-two. Working bets have action.

b. Intermediate Roll—When there is a point, either big or small.

1. Triple ones, all bets in. Then, stick dealer has to direct the base dealer to pay the triple ones.
2. One, one, two, it is four; double the 3 to 1 for any craps, five to one for one-two.
3. One, two, three, it is six; 3 to 1 for any craps, 5 to 1 for one-two, one-three, two-three. 15 to 1 for one-two-three straight (stick dealer has to direct the base dealer to paid the winner.).
4. Six, six, four, it is sixteen; 8 to 1 for hard six, 5 to 1 for four-six.

c. Decision Roll—When there is a point, for instance, Big, and Big rolled.

1. Six, five, two, it is 13, Big, winner. Take the Small, pay the Big, double the 13, 5 to 1 for five-six, two-six, and 8 to 1 for two fives.
2. Two, two, three, total is 7, Small, winner. Take the Big, pay the Small, double the 7, 5 to 1 for two-three, 8 to 1 for hard four.
3. Three, four, five, it is 12, Big, winner. Take the Small, pay the Big, even the 12, 5 to 1 for three-four, three-five, and four-five. Then, stick dealer has to direct base dealers to pay the 3-4-5 straight.

The invention claimed is:

1. A method of playing Let Me Roll Sic Bo, a blend Sic Bo and Craps dice game using three regular dice (cubes) with dots from one to six on each side on a traditional craps table style and size with Let Me Roll Sic Bo lay out and electronic display with a computer, comprising:

(a). providing a traditional craps table style game table having a computer driven display device under the table with designed Let Me Roll Sic Bo table layout comprising a plurality of wagering areas including:

a Line Bet segment, comprising a Big line area consisting of the numbers 11, 12, 13, 14 and a Small line area consisting of the numbers 7, 8, 9, 10, each number in the Line Bet segment representing a numerical total resulting from the sum of a roll of the three dice;

a Field Bet segment, comprising a big field area consisting of the numbers 4, 5, 6, 7, 8, 9, 10, a small field with numbers 11, 12, 13, 14, 15, 16, 17, an any craps area consisting of the numbers 3, 4, 5, 6, 15, 16, 17, 18, an even area consisting of the numbers 2-4-6 and an odd area consisting of the numbers 1-3-5, each number in the Line Bet segment representing a numerical total resulting from the sum of a roll of the three dice;

the Field Bet also comprising a two dice combination area consisting of the numbers 1-2, 1-3, 1-4, 1-5, 1-6, 2-3, 2-4, 2-5, 2-6, 3-4, 3-5, 3-6, 4-5, 4-6, 5-6, each number in the two dice combination area representing a numerical total resulting from the sum of a roll of two of the three dice;

a One Roll Bet segment comprising a triples area consisting of the three dice combinations of 1-1-1, 2-2-2, 3-3-3, 4-4-4, 5-5-5, 6-6-6, an any triples area an any 4 and 17 area consisting of the numbers 1-1-2, 5-6-6, an any 5 and 16 area consisting of the numbers 1-2-2, 1-1-3, 5-5-6, 4-6-6, an any 6 and 15 area consisting of the numbers 1-1-4, 2-2-2 and 4-5-6, 5-5-5, a straight area consisting of the numbers 1-2-3, 2-3-4, 3-4-5, 4-5-6, each number in the One Roll Bet segment representing a numerical total resulting from the sum of a roll of the three dice;

a Place Bet segment, comprising a Big hard ways area consisting of the numbers 6-6, 5-5, 4-4, and a Small hard ways area consisting of the numbers 1-1, 2-2, 3-3; each number in the Place Bet segment representing a numerical total resulting from the sum of a roll of two of the three dice:

(b). providing three regular cubic dice, each die having six faces with dots from one to six;

(c). require one of the players to place a bet on either Big line or Small line to qualify shooting the three dice repeatedly to establish the point and repeatedly shoot the dice to make a winner or lose the game;

(e). providing a game rule including: requiring player to be the shooter to shoot the dice in three phases; named come-out roll, intermediate roll, and decision roll from one end of the table to the other end of the table;

come-out roll, is making a first throw by rolling the three dice by the shooter; shooter initially place wager on Big line or Small line to be qualify throwing three dice to win or lose based on total numbers of three dice resulting from a roll, shooter repeatedly throwing three dice to establish a point corresponding to the numbers on Big line or Small line, intermediate roll, is continuing throwing; after the point is established, shooter repeatedly throwing three dice without making a winning point that is established on the come-out roll to win the game, or without making a losing point that is the opposite point of the point established on the come-out roll;

and decision roll; is making the last throw, shooter throwing three dice and making a winning point that is established on the come-out roll to win the game, or making a losing point that is the opposite point of the point established on the come-out roll;

(f). providing a game rule including: assigned line bet, Big line and Small line, as contract bet area; requiring players to place a bet on either the Big line or Small line wagering areas to qualify be the shooter; requiring bets placed on the Big line and Small line wagering area that did not win or lose on the come-out roll, to remain on the Big line and Small line wagering areas until these bet win or lose on successive rolls of the three dice; establishing a point when the number combination from the come out of the three dice correspond to any of the numerical total 7, 8, 9, 10, 11, 12, 13, 14;

(g). providing a game rule including: assigned field bet as self bet area; players optionally placing bets on field by themselves;

(h). providing a game rule including: assigned place bet as a continue betting area; requiring dealer set the bets for player; the big hard ways lose when and small straight, 1-2-3 and 2-3-4, and Small line points rolled, the small hard ways lose when big straight, 4-5-6 and 3-4-5, and Big line points rolled;

(i). providing a game rule including: assigned one roll bet as set bet area; requiring dealer set the bets for player;

(j). allowing players optionally placing bets on any of the other wagering areas of the game table; to wager on different combination from 3 to 18 that is a result from a rolling three dice; if a point is established on the come-out roll, throwing the three dice again by the shooter, then settling the bets placed on the Hard Ways wagering area, any 4 and 17, any 5, and 16, straight wagering area, and the bets on the Triples wagering area;

(k). providing different payout with different odds to different number based on a math analysis; settling bets by paying a winning player if the number combination from the come-out roll, intermediate roll, and decision roll of the dice corresponds to any combination on any of the wagering areas that the player placed a bet on; except the bets placed on the Hard Ways wagering area and bets placed on the triples wagering areas are not settled on the come-out roll;

(l). require shooter place wager on either provided two designed contract betting lines named, Big Line and Small Line to be qualify shooting the dice repeatedly; on the come-out roll, the wager on Big line loses on any triples, pushes on 4, 5, and 6 and wins on 15, 16, and 17, each number is resulting from the sum of a roll of three dice; the wager on Small line loses on any triples, pushes on 15, 16, and 17, and wins on 4, 5, and 6, each number is resulting from the sum of a roll of the three dice;

(m). provide different combination numbers betting spots from 3 to 18 that is result from a shooting three dice for patrons wagering on them any time during the game; including two dice numbers out of three dice number that is a result from a rolling three dice;

(n). requiring players shoot three dice on a craps table to establish the winning point called come-out roll, continue to shoot the three dice to win other betting on different combination numbers before shoot the numbers of Big line or Small line called intermediate-roll, and shoot the numbers of Big line or Small line to win or lose the wager called decision roll;

settling bets by collecting bets from a losing player or paying bets to a winning player if the number combination from the come-out roll of the three dice correspond to Any craps number 4, 5, 6, 15, 16, 17, and triples, and collecting bets from the losing player placed a bet on either the Big wagering area or the Small wagering area or paying bets to the winning player placed a bet on either the Big wagering area or small wagering area;

settling bets by collecting bets from a losing player if the number combination from the come-out roll of the three dice correspond to any of the number on the Small wagering area and player placed a bet on any of the numbers on the Big wagering area;

settling bets by collecting bets from a losing player if the number combination from the come-out roll of the three dice correspond to any of the number on the Big wagering area and player placed a bet on any of the numbers on the Small wagering area;

settling bets by collecting bets from a losing player or paying bets to a winning player if the number combination from the intermediate roll of the three dice correspond to any of the number on the big wagering area, small wagering area, one roll bet wagering and field wagering area:

settling bets by collecting bets from a losing player if the number combination from the decision roll of the three dice correspond to any of the number on the Big wagering area and player placed a bet on Small wagering, or settling bets by collecting bets from a losing player if the number combination from the decision roll of the three dice correspond to any of the number on the Small wagering area and player placed a bet on Big wagering area;

settling bets by collecting bets from a losing player or paving bets to a winning player if the number combination from the decision roll of the three dice correspond to any of the number on the big wagering area, small wagering, one roll bet wagering and field wagering area.

2. The method of playing claim 1, wherein, (a) require patrons place a minimum wager or more on Big line bet or a Small line bet to be qualified shooting dice and making initial roll to establish the point corresponding to big line, 11, 12, 13, 14 and small line, 7, 8, 9, 10, each number representing a numerical total resulting from the sum of a roll of three dice:

(b) requiring a shooter rolling three dice repeatedly to establish the winning point, the numbers on the big line or small line, and repeatedly rolling three dice until to win or lose the wager placed on winning point, the numbers on the big line or small line;

(c) declaring that 11, 12, 13, and 14 is the numbers represent the Big line and declaring that 7, 8, 9, and 10 represent the Small line; shooter throw one of the numbers to establish the winning point on the come-out roll, and throw one of the same numbers to win or the opposite number to lose on the decision roll;

on the initial roll, or come-out, the total number on the face up of three dice after a roll results in a win for bettor is 4, 5 and 6 if bettors place wager on Small line;

on the initial roll, or come-out, the total number on the face up of three dice after a roll results in a win for bettor is 15,16 and 17 if bettors place wager on Big line;

(d) declaring that on the initial roll, the wager on Small line loses when any triples, such as, 6-6-6-, 5-5-5, 4-4-4, 3-3-3, 2-2-2, and 1-1-1 rolled; wins when 4, 5, or 6 rolled; and pushes when 15, 16, or 17 rolled;

(e) declaring that on the initial roll, the wager on Big line loses when any triples, such as, 6-6-6-, 5-5-5, 4-4-4, 3-3-3, 2-2-2, and 1-1-1 rolled; wins when 15,16, or 17 rolled; and pushes when 4, 5, or 6 rolled;

(f) after the winning point is established, shooter repeatedly shooting dice is called intermediate roll, the wagers on all other combination numbers will be take or pay according to rules of the game;

(g) after the winning point is established, shooter shoot a number corresponding to the numbers of Big line or Small line is called decision-roll; shooter wins or lose is depend on which line bet he was wager on and which number he made;

shooter wagers on big line and established the point on big line, shooter has to make the point on big line to win the game; if shooter make the point on small line, shooter will lose the game, and pass the dice to next shooter;

shooter wagers on small line and established the point on small line, shooter has to make the point on small line to win the game; if shooter make the point on big line, shooter will lose the game, and pass the dice to next shooter;

shooter wagers on big line, but established the point on small line, shooter has to make the number on big line to win the game, but lose the right of shooting dice and pass the dice to next shooter; if shooter make the point on small line, shooter will lose the wager on big line, but still keep the right of shooting dice;

shooter wagers on small line, but established the point on big line, shooter has to make the point on small line to win the game; but lose the right of shooting dice and pass the dice to next shooter; if shooter make the point on big line, shooter will lose the wager on small line, but still keep the right of shooting dice.

3. The method of playing claim 1, wherein, providing different optional betting spots with different combination numbers that is resulting from a shooting of the three dice, the optional betting spots including:

(a) Line Bet: a contract bet, requiring bets placed on the big line and small line wagering area that did not win or lose on the come-out roll to remain on the big line and small line until bets win or lose on successive roll of the three dice:

Big Line wagering area consisting of the number 11, 12, 13, and 14, each number representing a numerical total resulting from the sum of a roll of the three dice;

Small Line wagering area consisting of the number 7, 8, 9, and 10, each number representing a numerical total resulting from the sum of a roll of the three dice;

(b) Self Bet: is one roll bet, player can placed bets on the come-out roll and intermediate roll;

Big Field wagering area consisting of the number 11, 12, 13, 14, 15, 16, and 17;

Small field wagering area consisting of the number 4, 5, 6, 7, 8, 9, and 10;

Even and odd wagering area consisting of the combination of three dice, 2-4-6 and 1-3-5;

Two numbers wagering area consisting of two dice combination of three dice, 1-2, 1-3, 1-4, 1-5, 1-6, 2-3, 2-4, 2-5, 2-6, 3-4, 3-5, 3-6, 4-5, 4-6, and 5-6;

(c) Place Bet: requiring dealer to placed the wagers for player on the come-out roll and intermediate roll;

Hard Ways wagering area consisting of the number of two dice result from a roll have the same number of dots on the face up side, such as, 1-1, 2-2, 3-3, 4-4, 5-5, and 6-6; wagers on big hard ways, 4-4, 5-5, 6-6, loses on any triples, small line, and small pairs resulting from the sum of a roll of two of three dice; wagers on small hard ways, 1-1, 2-2, 3-3, loses on any triples, big line, and big pairs, a numerical combination resulting from the sum of a roll of three dice and a roll of two of three dice;

(d) One Roll Bet:

Straight wagering area consisting of the numbers of 6, 9, 12, and 15 result from a roll of three dice with a consecutive number on the face up side, such as, 1-2-3-, 2-3-4, 3-4-5, and 4-5-6;

Triple wagering area consisting of the number 3, 6, 9, 12, 15, and 18 result from a roll of three dice with the same number of dots on the face up side, such as, 1-1-1, 2-2-2, 3-3-3, 4-4-4, 5-5-5, and 6-6-6;

Even dice wagering area consisting of the number of 12 result from a roll of three dice, such as, 2-4-6;

Odd dice wagering area consisting of the number of 9 result from a roll of three dice such as, 1-3-5;

Two Numbers wagering area consisting of the number of 3, 4, 5, 6, 7, 8, 9, 10, and 11, from two dice of a roll of three dice such as, 1-2, 1-3, 1-4, 1-5, 1-6, 2-3, 2-4, 2-5, 2-6, 3-4, 3-5, 3-6, 4-5, 4-6, and 5-6;

Any Craps wagering area consisting of number of 4, 5, 16, and 17 result from a roll of three dice, such as, 1-1-2, 1-2-2, 1-1-3, 4-6-6, 5-5-6, and 6-6-5;

Any 6 and 15 wagering area consisting of number result from a roll of three dice, such as 1-2-3, 2-2-2, 1-1-4, 5-5-5, 4-5-6, and 3-6-6.

4. The method of playing claim 1, wherein,

Line Bet is a contract bet in order for patron to shoot the dice; shooter must to roll the corresponding number to the Big Line, 11, 12, 13, 14, or Small Line, 7, 8, 9, 10, establishing the point and roll the same point to win the game or roll the opposite point to lose the game.

5. The method of playing claim 1, wherein,

Hard Ways is betting on the pairs of two dice result from a roll of three dice; wagers on Small pairs, 1-1, 2-2, and 3-3 lose when any triples, Big line and Big pairs rolled; wagers on Big pairs, 4-4, 5-5, and 6-6 lose when any triples, Small line and Small pairs rolled; player can require Hard Ways working on the come-out roll.

6. The method of playing claim 1, wherein, (a) require shooter makes a wager on either Big line or Small line in order to shot the dice and to establish the point called Come Out roll; the wagers on big line will lose when any triples rolled, push when 4, 5, and 6 rolled, and win when 15, 16, and 17 rolled; the wagers on small line will lose when any triples rolled, push when 15, 16, and 17 rolled, and win when 4, 5, 6 rolled;

(b) if shooter wagers on big line, he/she has to roll the numbers on big line to establish the point that is not against to himself; and roll the numbers on big line again to win the game; if shooter wagers on small line, he/she has to roll the numbers on small line to establish the point that is not against to he himself; and roll the numbers on small line again to win the game;

(d) if shooter wagers on Big line, but rolled numbers on small line to establish the point, the shooter will lose his wager on the BIG line if he repeats the number on small line; the wagers on SMALL line get paid; however, the shooter still has the right to shot the dice with placing another wager on either BIG line or SMALL line;

if shooter wagers on SMALL line, but rolls numbers on big line to establish the point, the shooter will lose his wager on the SMALL line if he repeats the numbers on big line; the wagers on BIG get paid; however, the shooter still has the right to shot the dice with placing another wager on either BIG line or SMALL line;

(e) after the point is established, which is call intermediate roll, the wagers on other number will be pay or take based on the number result from a roll of three dice and the rules;

(f) decision roll is when shooter rolls the point or the opposite of the point; shooter will lose his/her bet and the right of shooting dice when he/she shoots the opposite point; shooter will continue shoot the dice when he/she shoot the point.

7. The method of playing claim 1, wherein, (a) providing three dice having six faces numbered one to six for player shooting the numbers; player should roll the three dice from one side of the table to the other side of the table (standard craps table);

(b) The total numbers of dots on the up face of three dice, after the dice are land on the table, are used to determine the outcome of the winning on betting;

(c) players can bet on two dice combination out of three dice combination and three dice combination;

(d) Big line and Small line bet pays even money; Hard Ways (pair) pays 8 to 1; Triple pays 150 to 1; straight pays 6 to 1; 15 and 6 pays 15 to 1; 16 and 5 pays 25 to 1; 17 and 4 pays 50 to 1; 4 to 10 pays even; 11 to 17 pay even; Any triple pays 30 to 1; odds and even pays 6 to 1; and two numbers of three dice pays 5 to 1.

* * * * *